US011535491B2

(12) United States Patent
Pahlke

(10) Patent No.: US 11,535,491 B2
(45) Date of Patent: Dec. 27, 2022

(54) VERIFICATION OF TRAPPED PASSENGER ALARM

(71) Applicant: Otis Elevator Company, Farmington, CT (US)

(72) Inventor: Derk Oscar Pahlke, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 931 days.

(21) Appl. No.: 16/367,373

(22) Filed: Mar. 28, 2019

(65) Prior Publication Data

US 2020/0307953 A1 Oct. 1, 2020

(51) Int. Cl.

| | |
|---|---|
| ***B66B 5/00*** | (2006.01) |
| ***B66B 1/28*** | (2006.01) |
| ***B66B 5/02*** | (2006.01) |

(52) U.S. Cl.

CPC ..... *B66B 5/0012* (2013.01); *B66B 1/28* (2013.01); *B66B 5/0018* (2013.01); *B66B 5/027* (2013.01)

(58) Field of Classification Search

CPC ..... B66B 5/02; B66B 5/0031; B66B 5/027; B66B 5/0012; B66B 3/00; B66B 5/0018; B66B 5/024; B66B 5/0037; B66B 5/00; B66B 5/0006; B66B 3/002; B66B 5/021; B66B 13/26; B66B 1/3446; B66B 11/024; B66B 13/24; B66B 5/025; B66B 5/04

See application file for complete search history.

(56) References Cited

U.S. PATENT DOCUMENTS

| | | | | |
|---|---|---|---|---|
| 5,780,787 | A * | 7/1998 | Kamani | B66B 13/143 187/390 |
| 6,364,066 | B1 * | 4/2002 | Bolch | B66B 5/027 187/391 |
| 8,365,871 | B2 * | 2/2013 | Lee | B66B 5/027 187/247 |
| 8,540,057 | B2 | 9/2013 | Schuster et al. | |
| 2011/0253486 | A1 * | 10/2011 | Lee | B66B 5/027 187/392 |
| 2018/0057307 | A1 | 3/2018 | Halingale | |
| 2018/0118507 | A1 | 5/2018 | Jyotik et al. | |

(Continued)

FOREIGN PATENT DOCUMENTS

| | | | |
|---|---|---|---|
| CN | 102826419 | A | 12/2012 |
| CN | 104760857 | A | 7/2015 |

(Continued)

OTHER PUBLICATIONS

European Search Report for Application No. 19215005.0; dated Jul. 10, 2020; 7 Pages.

(Continued)

*Primary Examiner* — Marlon T Fletcher
(74) *Attorney, Agent, or Firm* — Cantor Colburn LLP

(57) ABSTRACT

A method of verifying a trapped passenger alarm in an elevator system including an elevator car including a sensing apparatus mounted in the elevator car. The method includes obtaining at least one of acceleration of the elevator car and air pressure within the elevator car from the sensing apparatus; detecting the trapped passenger alarm; determining that the trapped passenger alarm is one of a valid trapped passenger alarm and a false trapped passenger alarm in response to the at least one of acceleration of the elevator car and air pressure within the elevator car.

16 Claims, 4 Drawing Sheets

FIG. 2

(56) References Cited

U.S. PATENT DOCUMENTS

| | | | | |
|---|---|---|---|---|
| 2018/0237259 | A1* | 8/2018 | Miyajima | B66B 5/02 |
| 2018/0346284 | A1* | 12/2018 | Swami | B66B 5/027 |
| 2020/0307953 | A1* | 10/2020 | Pahlke | B66B 1/28 |
| 2020/0307954 | A1* | 10/2020 | Pahlke | B66B 5/0018 |

FOREIGN PATENT DOCUMENTS

| | | | | | |
|---|---|---|---|---|---|
| CN | 104944245 | A | * | 9/2015 | |
| CN | 105731210 | A | * | 7/2016 | |
| CN | 105967018 | A | * | 9/2016 | |
| CN | 106115406 | A | | 11/2016 | |
| CN | 106144865 | A | * | 11/2016 | |
| CN | 106586758 | A | | 4/2017 | |
| CN | 206336872 | U | | 7/2017 | |
| CN | 206407775 | U | | 8/2017 | |
| CN | 206538064 | U | | 10/2017 | |
| CN | 107445005 | A | | 12/2017 | |
| CN | 206720508 | U | | 12/2017 | |
| CN | 107986126 | A | | 5/2018 | |
| CN | 107986127 | A | | 5/2018 | |
| CN | 108298393 | A | | 7/2018 | |
| CN | 108423505 | A | | 8/2018 | |
| CN | 108466889 | A | | 8/2018 | |
| CN | 108557603 | A | | 9/2018 | |
| CN | 108928705 | A | * | 12/2018 | |
| CN | 208279158 | U | | 12/2018 | |
| CN | 109292566 | A | | 2/2019 | |
| CN | 109368435 | A | | 2/2019 | |
| CN | 110562819 | A | * | 12/2019 | B66B 1/3423 |
| CN | 106348119 | B | * | 3/2020 | B66B 5/0031 |
| CN | 108975114 | B | * | 5/2021 | B66B 1/3461 |
| EP | 1867595 | A1 | | 12/2007 | |
| EP | 3715301 | A1 | * | 9/2020 | B66B 1/28 |
| EP | 3771680 | A1 | * | 2/2021 | B66B 1/3492 |
| JP | 2018065694 | A | | 4/2018 | |
| WO | 2006048497 | A1 | | 5/2006 | |

OTHER PUBLICATIONS

Chinese Office Action for Application No. 201911415406.5; dated Apr. 19, 2021; 11 Pages.

Chinese Office Action for Application No. 201911415406.5; dated Nov. 2, 2021; 12 Pages.

Xiao Lin Chun-il; "The Nature of the Internet of Things: The Winner Strategy of IoT"; Guangdong Peoplechar(39)s Publishing House; 1st Edition; Common Sense Evidence Two; p. 138; Sep. 30, 2018.

Zhiqi et al.; "Installation Engineering Detection Technology"; China Building Materials Industry Press; 1st edition; General Knowledge Evidence 1; p. 247; Aug. 31, 2006.

* cited by examiner

VERIFICATION OF TRAPPED PASSENGER ALARM

BACKGROUND

The embodiments herein relate to the field of elevator systems, and more particularly to verifying a trapped passenger alarm in an elevator system.

Passengers may become trapped in an elevator car. In such situations, the passenger may initiate a trapped passenger alarm from within the elevator car through an alarm button. There are situations where the passenger inadvertently activates the trapped passenger alarm. To verify that the trapped passenger alarm is valid (i.e., a passenger is actually trapped in the elevator car), the elevator controller may be accessed to determine the operational state of the elevator car. In situations where the elevator controller cannot be accessed, it is difficult to verify if the trapped passenger alarm is valid.

BRIEF SUMMARY

According to an embodiment, a method of verifying a trapped passenger alarm in an elevator system including an elevator car including a sensing apparatus mounted in the elevator car includes obtaining at least one of acceleration of the elevator car and air pressure within the elevator car from the sensing apparatus; detecting the trapped passenger alarm; determining that the trapped passenger alarm is one of a valid trapped passenger alarm and a false trapped passenger alarm in response to the at least one of acceleration of the elevator car and air pressure within the elevator car.

In addition to one or more of the features described herein, or as an alternative, further embodiments may include wherein determining that the trapped passenger alarm is one of the valid trapped passenger alarm and the false trapped passenger alarm comprises determining if the elevator car is stopped.

In addition to one or more of the features described herein, or as an alternative, further embodiments may include wherein upon determining that the elevator car is stopped, determining if an elevator car door is open or closed.

In addition to one or more of the features described herein, or as an alternative, further embodiments may include wherein upon determining that the elevator car door is open, determining that the trapped passenger alarm is the false trapped passenger alarm.

In addition to one or more of the features described herein, or as an alternative, further embodiments may include wherein upon determining that the elevator car door is closed, determining that the trapped passenger alarm is the valid trapped passenger alarm.

In addition to one or more of the features described herein, or as an alternative, further embodiments may include wherein determining that the elevator car door is open or closed is responsive to a acceleration of the elevator car responsive to movement of the elevator car door.

In addition to one or more of the features described herein, or as an alternative, further embodiments may include wherein determining that the elevator car door is open or closed is responsive to the light level inside the elevator car.

In addition to one or more of the features described herein, or as an alternative, further embodiments may include wherein upon determining that the elevator car is not stopped, moving the elevator car to a landing.

In addition to one or more of the features described herein, or as an alternative, further embodiments may include wherein upon moving the elevator car to the landing, determining if an elevator car door is open or closed.

In addition to one or more of the features described herein, or as an alternative, further embodiments may include wherein upon determining that the elevator car door is open, determining that the trapped passenger alarm is the false trapped passenger alarm.

In addition to one or more of the features described herein, or as an alternative, further embodiments may include wherein upon determining that the elevator car door is closed, determining that the trapped passenger alarm is the valid trapped passenger alarm.

In addition to one or more of the features described herein, or as an alternative, further embodiments may include wherein determining that the elevator car door is open or closed is responsive to the acceleration of the elevator car responsive to movement of the elevator car door.

In addition to one or more of the features described herein, or as an alternative, further embodiments may include wherein determining that the elevator car door is open or closed is responsive to a light level inside the elevator car.

In addition to one or more of the features described herein, or as an alternative, further embodiments may include wherein determining that the trapped passenger alarm is one of the valid trapped passenger alarm and the false trapped passenger alarm comprises determining if the elevator car is occupied.

In addition to one or more of the features described herein, or as an alternative, further embodiments may include wherein upon determining that the elevator car is not occupied, determining that the trapped passenger alarm is the false trapped passenger alarm.

According to another embodiment, an elevator system includes an elevator car having an elevator car door; a sensing apparatus mounted in the elevator car, the sensing apparatus configured to measure at least one of acceleration of the elevator car and air pressure within the elevator car; a processor configured to execute operations including: obtaining at least one of the acceleration of the elevator car and the air pressure within the elevator car from the sensing apparatus; detecting a trapped passenger alarm; determining that the trapped passenger alarm is one of a valid trapped passenger alarm and a false trapped passenger alarm.

According to another embodiment, a computer program product is tangibly embodied on a computer readable medium, the computer program product including instructions that, when executed by a processor, cause the processor to perform operations for verifying a trapped passenger alarm in an elevator system having an elevator car including a sensing apparatus mounted in the elevator car, the operations comprising: obtaining at least one of acceleration of the elevator car and air pressure within the elevator car from the sensing apparatus; detecting the trapped passenger alarm; determining that the trapped passenger alarm is one of a valid trapped passenger alarm and a false trapped passenger alarm in response to the at least one of acceleration of the elevator car and air pressure within the elevator car.

Technical effects of embodiments of the present disclosure include the ability to distinguish between a false trapped passenger alarm and a valid trapped passenger alarm.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
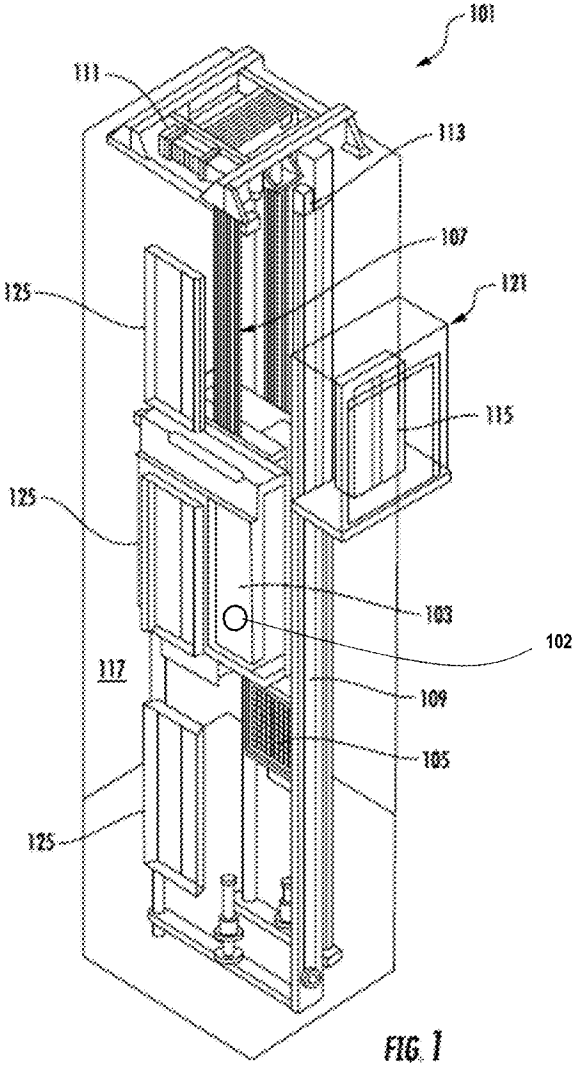
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

The elevator car 103 includes a trapped passenger alarm input 102. The trapped passenger alarm input 102 may be a button that is part of a car operating panel. To initiate the trapped passenger alarm, a passenger would press the trapped passenger alarm input 102. The trapped passenger alarm input 102 may also be implemented using a microphone to detect auditory data from the inside of the elevator car 103. A passenger may use spoken phrases to initiate the trapped passenger alarm.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figures 2, 3:
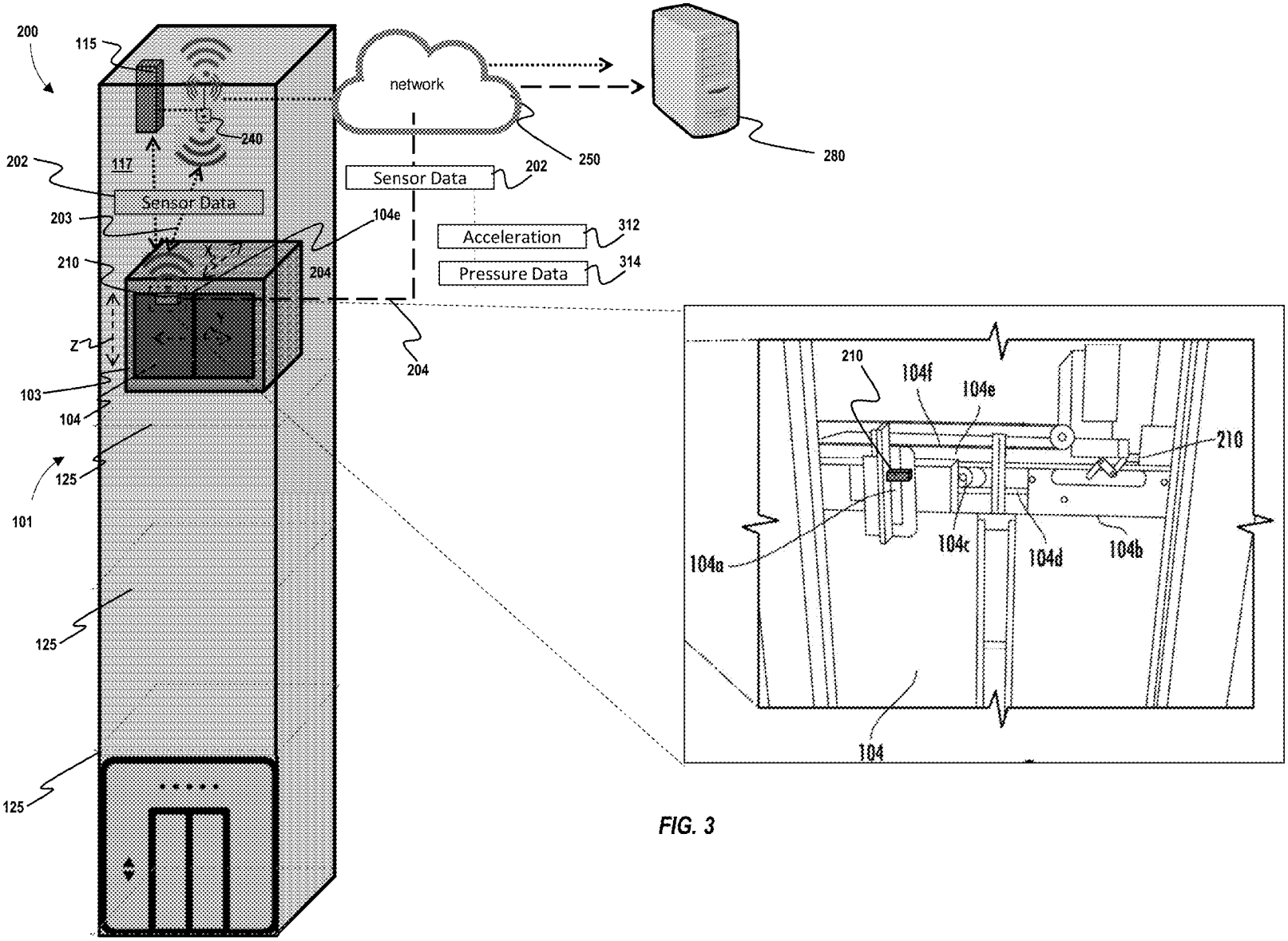
FIG. 2 is a schematic illustration of a sensor system for the elevator system of FIG. 1, in accordance with an embodiment of the disclosure.
FIG. 3 is a schematic illustration of the location of sensing apparatus of the sensor system of FIG. 2, in accordance with an embodiment of the disclosure.

Referring now to FIG. 2, with continued referenced to FIG. 1, a view of a sensor system 200 including a sensing apparatus 210 is illustrated, according to an embodiment of the present disclosure. The sensing apparatus 210 is configured to detect sensor data 202 of the elevator car 103 and transmit the sensor data 202 to a remote device 280. Sensor data 202 may include but is not limited to pressure data 314, vibratory signatures (i.e., vibrations over a period of time) or accelerations 312 and derivatives or integrals of accelerations 312 of the elevator car 103, such as, for example, distance, velocity, jerk, jounce, snap . . . etc. Sensor data 202 may also include light and occupancy within the elevator car, or any other desired data parameter. A load sensor (e.g., a strain gauge) may be placed on the elevator car beam or hitch. The pressure data 314 may include atmospheric air pressure within the elevator car 103 or elevator shaft 117. It should be appreciated that, although particular systems are separately defined in the schematic block diagrams, each or any of the systems may be otherwise combined or separated via hardware and/or software. For example, the sensing apparatus 210 may be a single sensor or may be multiple separate sensors that are interconnected.

In an embodiment, the sensing apparatus 210 is configured to transmit sensor data 202 that is raw and unprocessed to the controller 115 of the elevator system 101 for processing. In another embodiment, the sensing apparatus 210 is configured to process the sensor data 202 prior to transmitting the sensor data 202 to the controller 115. In another embodiment, the sensing apparatus 210 is configured to transmit sensor data 202 that is raw and unprocessed to a remote device 280 for processing. In yet another embodiment, the sensing apparatus 210 is configured to process the sensor data 202 prior to transmitting the sensor data 202 to the remote device 280.

The processing of the sensor data 202 may reveal data, such as, for example, a number of elevator door openings/closings, elevator door time, vibrations, vibratory signatures, a number of elevator rides, elevator ride performance, elevator flight time, probable car position (e.g. elevation, floor number), releveling events, rollbacks, elevator car 103 *x, y* acceleration at a position: (i.e., rail topology), elevator car 103 *x, y* vibration signatures at a position: (i.e., rail topology), door performance at a landing number, nudging event, vandalism events, emergency stops, etc.

The remote device 280 may be a computing device, such as, for example, a desktop or cloud computer. The remote device 280 may also be a mobile computing device that is typically carried by a person, such as, for example a smartphone, PDA, smartwatch, tablet, laptop, etc. The remote device 280 may also be two separate devices that are synced together, such as, for example, a cellular phone and a desktop computer synced over an internet connection. The remote device 280 may also be a cloud computing network.

The sensing apparatus 210 is configured to transmit the sensor data 202 to the controller 115 or the remote device 280 via short-range wireless protocols 203 and/or long-range wireless protocols 204. Short-range wireless protocols 203 may include but are not limited to Bluetooth, Wi-Fi, HaLow (801.11ah), zWave, Zigbee, or Wireless M-Bus. Using short-range wireless protocols 203, the sensing apparatus 210 is configured to transmit the sensor data 202 to directly to the controller 115 or to a local gateway device 240 and the local gateway device 240 is configured to transmit the sensor data 202 to the remote device 280 through a network 250 or to the controller 115. The network 250 may be a computing network, such as, for example, a cloud computing network, cellular network, or any other computing network known to one of skill in the art. Using long-range wireless protocols 204, the sensing apparatus 210 is configured to transmit the sensor data 202 to the remote device 280 through a network 250. Long-range wireless protocols 204 may include but are not limited to cellular, satellite, LTE (NB-IoT, CAT M1), LoRa, Satellite, Ingenu, or SigFox.

The sensing apparatus 210 may be configured to detect sensor data 202 including acceleration in any number of directions. In an embodiment, the sensing apparatus may detect sensor data 202 including accelerations 312 along three axis, an X axis, a Y axis, and a Z axis, as shown in FIG. 2. The X axis may be perpendicular to the doors 104 of the elevator car 103, as shown in FIG. 2. The Y axis may be parallel to the doors 104 of the elevator car 103, as shown in FIG. 2. The Z axis may be aligned vertically parallel with the elevator shaft 117 and pull of gravity, as shown in FIG. 2. Vibratory signatures may be generated along the X-axis and the Y-axis as the elevator car 103 moves along the Z-axis.

FIG. 3 shows a possible installation location of the sensing apparatus 210 within the elevator system 101. The sensing apparatus 210 may include a magnet (not show) to removably attach to the elevator car 103. In the illustrated embodiment shown in FIG. 3, the sensing apparatus 210 may be installed on the door hanger 104*a* of the elevator system 101. It is understood that the sensing apparatus 210 may also be installed in other locations other than the door hanger 104*a* of the elevator system 101. In another embodiment, the sensing apparatus 210 may be attached to a door header 104*e* of a door 104 of the elevator car 103. In another embodiment, the sensing apparatus 210 may be located on a door header 104*e* proximate a top portion 104*f* of the elevator car 103. In another embodiment, the sensing apparatus 210 is installed elsewhere on the elevator car 103, such as, for example, directly on the door 104. The light sensor 226 may be mounted inside the elevator car 103. A load sensor may be mounted on a beam of the elevator car 103.

As shown in FIG. 3, the sensing apparatus 210 may be located on a door hanger 104*a*. The doors 104 are operably connected to the door header 104*e* through a door hanger 104*a* located proximate a top portion 104*b* of the door 104. The door hanger 104*a* includes guide wheels 104*c* that allow the door 104 to slide open and close along a guide rail 104*d* on the door header 104*e*. Advantageously, the door hanger 104*a* is an easy to access area to attach the sensing apparatus 210 because the door hanger 104*a* is accessible when the elevator car 103 is at landing 125 and the elevator door 104 is open. Thus, installation of the sensing apparatus 210 is possible without taking special measures to take control over the elevator car 103. For example, the additional safety of an emergency door stop to hold the elevator door 104 open is not necessary as door 104 opening at landing 125 is a normal operation mode. The door hanger 104*a* also provides ample clearance for the sensing apparatus 210 during operation of the elevator car 103, such as, for example, door 104 opening and closing. Due to the mounting location of the sensing apparatus 210 on the door hanger 104*a*, the sensing apparatus 210 may detect open and close motions (i.e., acceleration) of the door 104 of the elevator car 103 and a door at the landing 125. Additionally mounting the sensing apparatus 210 on the hanger 104*a* allows for recording of a ride quality of the elevator car 103.

Figure 4:
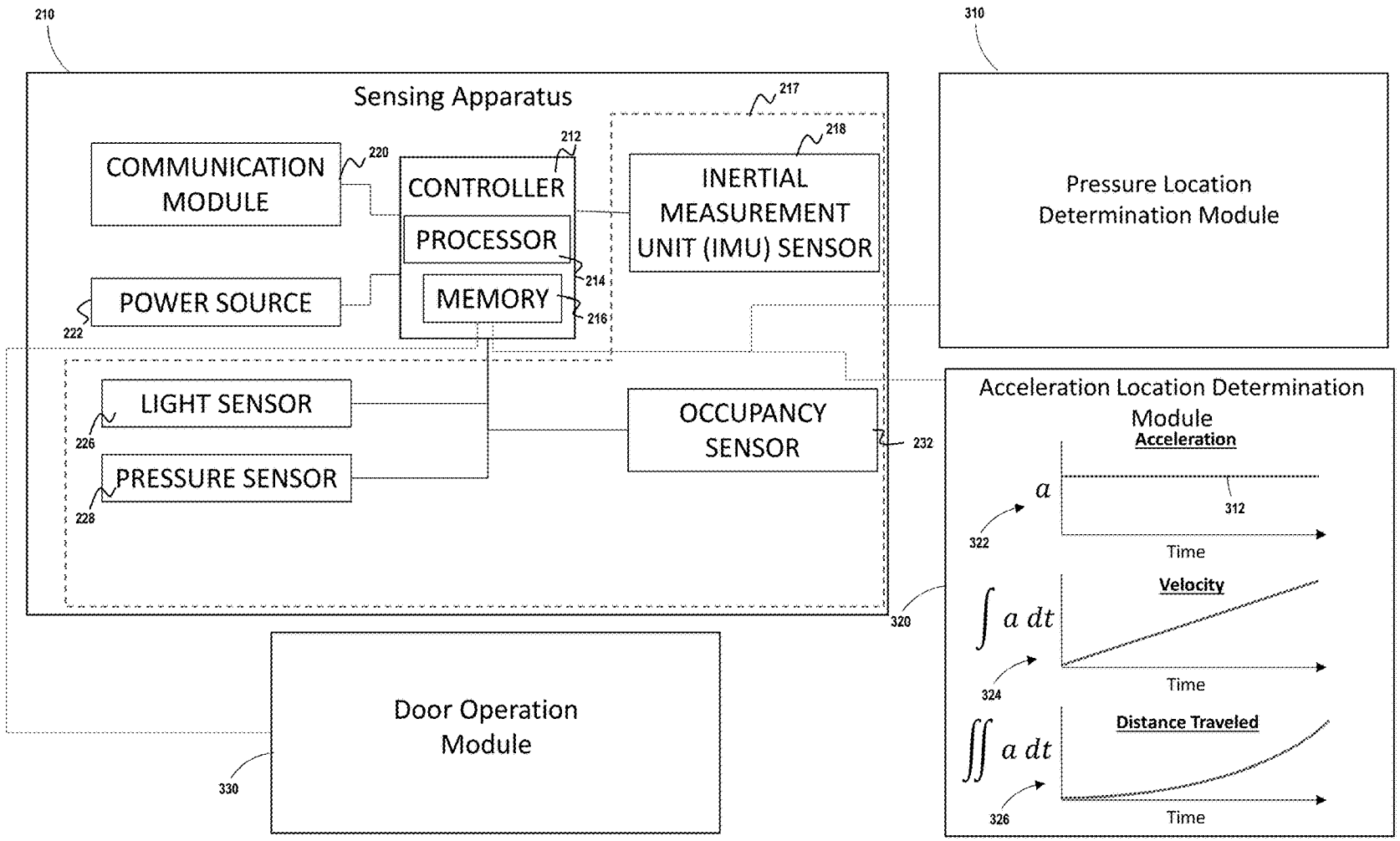
FIG. 4 is a schematic illustration of a sensing apparatus of the sensor system of FIG. 2, in accordance with an embodiment of the disclosure.

FIG. 4 illustrates a block diagram of the sensing apparatus 210 of the sensing system of FIGS. 2 and 3. It should be appreciated that, although particular systems are separately defined in the schematic block diagram of FIG. 4, each or any of the systems may be otherwise combined or separated via hardware and/or software. As shown in FIG. 4, the sensing apparatus 210 may include a controller 212, a plurality of sensors 217 in communication with the controller 212, a communication module 220 in communication with the controller 212, and a power source 222 electrically connected to the controller 212.

The plurality of sensors 217 includes an inertial measurement unit (IMU) sensor 218 configured to detect sensor data 202 including accelerations 312 of the sensing apparatus 210 and the elevator car 103 when the sensing apparatus 210 is attached to the elevator car 103. The IMU sensor 218 may be a sensor, such as, for example, an accelerometer, a gyroscope, or a similar sensor known to one of skill in the art. The accelerations 312 detected by the IMU sensor 218 may include accelerations 312 as well as derivatives or integrals of accelerations, such as, for example, velocity, jerk, jounce, snap . . . etc. The accelerations 312 detected by the IMU sensor 218 may also indicate opening and closing of the elevator car door 104. The IMU sensor 218 is in communication with the controller 212 of the sensing apparatus 210.

The plurality of sensors 217 includes a pressure sensor 228 configured to detect sensor data 202 including pressure data 314, such as, for example, atmospheric air pressure within the elevator shaft 117. The pressure sensor 228 may be a pressure altimeter or barometric altimeter in two non-limiting examples. The pressure sensor 228 is in communication with the controller 212.

The plurality of sensors 217 may also include additional sensors including but not limited to a light sensor 226 and an occupancy sensor 232. The light sensor 226 is configured to detect sensor data 202 including light level in the elevator car 103. The light sensor 226 is in communication with the controller 212. The occupancy sensor 232 detects the presence of a passenger within the elevator car 103. The occupancy sensor 232 is in communication with the controller 212. The occupancy sensor 232 may use a variety of techniques to detect occupancy including motion detection (e.g., PIR), radar, biometric sensing, load weighing, sound detection, phone detection, etc.

The controller 212 of the sensing apparatus 210 includes a processor 214 and an associated memory 216 comprising computer-executable instructions that, when executed by the processor 214, cause the processor 214 to perform various operations, such as, for example, processing the sensor data 202 collected by the IMU sensor 218, the light sensor 226, the pressure sensor 228 and the occupancy sensor 232. In an embodiment, the controller 212 may process the accelerations 312 and/or the pressure data 314 in order to determine a probable location of the elevator car 103, discussed further below. In an embodiment, the controller 212 may process the accelerations 312 in order to determine elevator door status of the elevator car door 104, discussed further below. The processor 214 may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 216 may be a storage device, such as, for example, a random access memory (RAM), read only memory (ROM), or other electronic, optical, magnetic or any other computer readable medium.

The power source 222 of the sensing apparatus 210 is configured to store and supply electrical power to the sensing apparatus 210. The power source 222 may include an energy storage system, such as, for example, a battery system, capacitor, or other energy storage system known to one of skill in the art. The power source 222 may also generate electrical power for the sensing apparatus 210. The power source 222 may also include an energy generation or electricity harvesting system, such as, for example synchronous generator, induction generator, or other type of electrical generator known to one of skill in the art.

The sensing apparatus 210 includes a communication module 220 configured to allow the controller 212 of the sensing apparatus 210 to communicate with the remote device 280 or controller 115 through at least one of short-range wireless protocols 203 and long-range wireless protocols 204. The communication module 220 may be configured to communicate with the remote device 280 using short-range wireless protocols 203, such as, for example, Bluetooth, Wi-Fi, HaLow (801.11ah), Wireless M-Bus, zWave, Zigbee, or other short-range wireless protocol known to one of skill in the art. Using short-range wireless protocols 203, the communication module 220 is configured to transmit the sensor data 202 to a local gateway device 240 and the local gateway device 240 is configured to transmit the sensor data to a remote device 280 through a network 250, as described above. The communication module 220 may be configured to communicate with the remote device 280 using long-range wireless protocols 204, such as for example, cellular, LTE (NB-IoT, CAT M1), LoRa, Ingenu, SigFox, Satellite, or other long-range wireless protocol known to one of skill in the art. Using long-range wireless protocols 204, the communication module 220 is configured to transmit the sensor data 202 to a remote device 280 through a network 250. In an embodiment, the short-range wireless protocol 203 is sub GHz Wireless M-Bus. In another embodiment, the long-range wireless protocol is Sigfox. In another embodiment, the long-range wireless protocol is LTE NB-IoT or CAT M1 with 2G fallback.

The door operation module 330 may utilize various approaches to determine a status of the elevator car door 104. The door operation module 330 may use vibration from the IMU 218 to detect door open and door closed conditions of the elevator car door 104. The door operation module 330 may also use light level from the light sensor 226 to detect if the elevator car door 104 is open or closed. The door operation module 330 may also use both vibration from the IMU 218 and the light level from the light sensor 226 to detect if the elevator car door 104 is open or closed.

The acceleration location determination module 320 is configured to determine a distance traveled of the elevator car 103 within the elevator shaft 117 in response to the acceleration of the elevator car 103 detected along the Y axis. The sensing apparatus 210 may detect an acceleration along the Y axis shown at 322 and may integrate the acceleration to get a velocity of the elevator car 103 at 324. At 326, the sensing apparatus 210 may also integrate the velocity of the elevator car 103 to determine a distance traveled by the elevator car 103 within the elevator shaft 117 during the acceleration 312 detected at 322. The direction of travel of the elevator car 103 may also be determined in response to the acceleration 312 detected. The acceleration location determination module 320 may then determine the location of the elevator car 103 within the elevator shaft 117 in response to a probable starting location and a distance traveled away from that probable starting location. The probable starting location may be based upon tracking the past operation and/or movement of the elevator car 103.

The pressure location determination module 310 is configured to detect an atmospheric air pressure within the elevator shaft 117 and/or the elevator car 103 when the elevator car 103 is in motion and/or stationary using the pressure sensor 228. The pressure detected by the pressure sensor 228 may be associated with a location (e.g., height, elevation) within the elevator shaft 117 through either a look up table or a calculation of altitude using the barometric pressure change in two non-limiting embodiments. The pressure may be measured at a known location (e.g., the lobby) to provide a baseline pressure at a fixed location to account for pressure changes from the weather. The direction of travel of the elevator car 103 may also be determined in response to the change in pressure detected via the pressure data 314. The pressure can be used to calculate the change in height (i.e., #of floors) over the course of a given run of the elevator car 103. The pressure can be collected over time (knowing the starting position) to keep track of where the elevator car 103 is located. Maintaining a record of the relative air pressure difference for a given distance between landings keeps track where the elevator car 103 is located In one embodiment, the pressure location determination module 310 may be used to verify and/or modify a location of the elevator car 103 within the elevator shaft 117 determined by the acceleration location determination module 320. In another embodiment, the acceleration location determination module 320 may be used to verify and/or modify a location of the elevator car 103 within the elevator shaft 117 determined by the pressure location determination module 310. In another embodiment, the pressure location determination module 310 may be prompted to determine a location of the elevator car 103 within the elevator shaft 117 in response to an acceleration detected by the IMU sensor 218.

Figure 5:
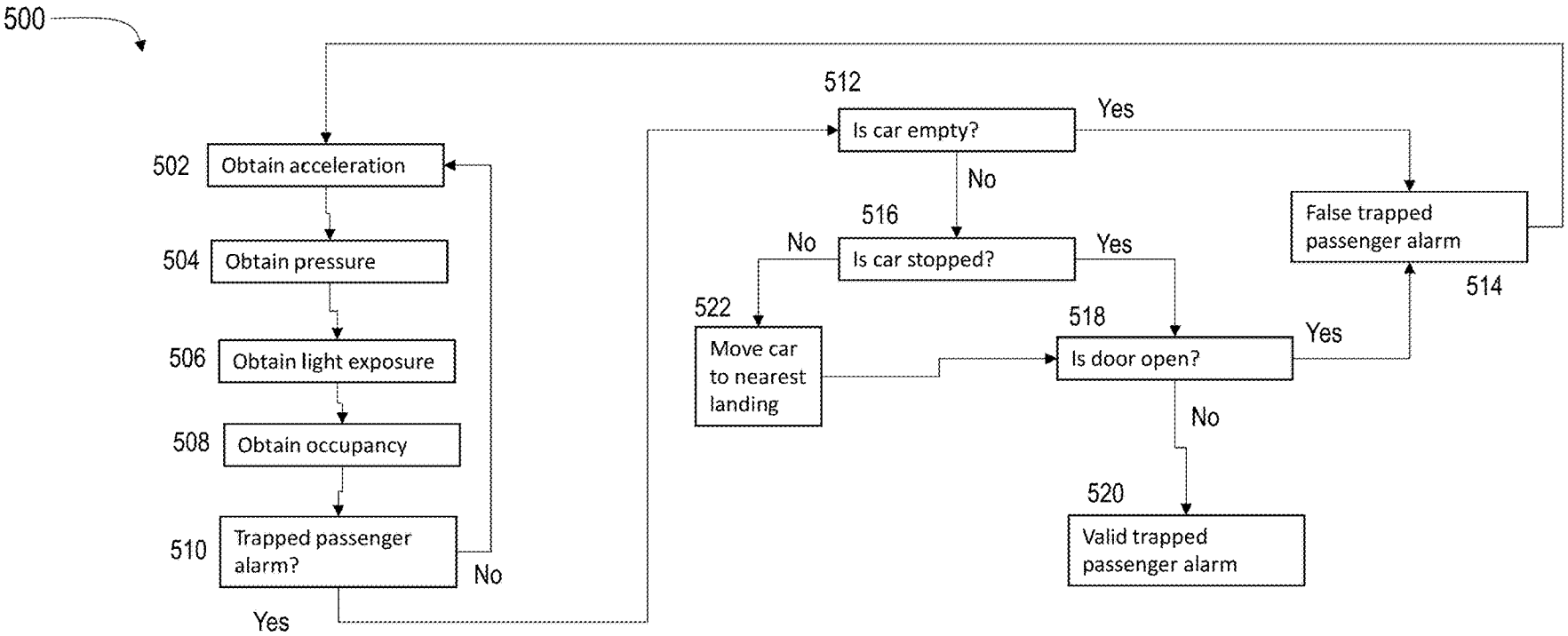
FIG. 5 is a flow chart of a method of verifying a trapped passenger alarm, in accordance with an embodiment of the disclosure.

FIG. 5 shows a flow chart of a method 500 of verifying a trapped passenger alarm, in accordance with an embodiment of the disclosure. In an embodiment, the conveyance system is an elevator system 101 and the conveyance apparatus is an elevator car 103. The process of FIG. 5 may be performed by the controller 115, the sensing apparatus 210, the remote device 280 or combination of these components executing various steps of the process of FIG. 5.

At block 502, acceleration of the elevator car 103 is obtained. In an embodiment, the acceleration of the elevator car 103 detected in block 502 corresponds to movement of the elevator car 103 in a direction about parallel to a direction of travel of the elevator car 103. For example, the acceleration of the conveyance apparatus may be that the elevator car 103 is moving through the elevator shaft 117. In another embodiment, the acceleration detected in block 502 is an acceleration of the elevator car 103 away from a stationary position. For example, the acceleration of the elevator car 103 may be that the elevator car 103 is accelerating from a velocity of zero to a velocity greater than zero. In another embodiment, the acceleration detected in block 502 is a deceleration of the elevator car 103 to a stationary position. For example, the acceleration of the elevator car 103 may be that the elevator car 103 is decelerating from a velocity greater than to a velocity of zero. In another embodiment, the acceleration detected in block 502 is a movement of the elevator car door 104 of the elevator car 103.

At block 504, an atmospheric air pressure within the elevator car 103 is detected using pressure sensor 228. At block 506, a light level within the elevator car 103 is detected using light sensor 226. At block 508, occupancy within the elevator car 103 is detected using occupancy sensor 232. Operations 506 and 508 may be optional, and implemented as part of a subsequent verification of a trapped passenger alarm in blocks 510-520.

At 510, the presence of a trapped passenger alarm is determined. As noted above, the trapped passenger alarm may be initiated through the trapped passenger alarm input 102 in the elevator car 103. If no trapped passenger alarm is present, flow returns to block 502.

If a trapped passenger alarm is present at block 510, flow proceeds to block 512 where a determination is made whether the elevator car 103 is empty. This is determined by the occupancy sensor 232. The occupancy of the elevator car 103 may be detected at block 508, or deferred until block 512. If the elevator car 103 is empty at block 512, flow proceeds to block 514 where the trapped passenger alarm is deemed a false trapped passenger alarm. The elevator system 101 can then resume normal operation by returning to block 502.

If the elevator car 103 is not empty at block 512, flow proceeds to block 516 where it is determined if the elevator car 103 car is stopped. This may be determined by monitoring vibration from the IMU 218 and/or from changes in pressure from the pressure sensor 228. If the elevator car is stopped at block 516, flow proceeds to block 518 where it is determined if the elevator car door 104 is open. This may be determined by the acceleration from the IMU 218 which indicates movement of the elevator car door 104. Light level from the light sensor 226 may also be used to detect if the elevator car door 104 is open. In an emergency situation, lighting in the elevator car 103 may dim. If the light level from the light sensor 226 is below a threshold, this indicates that the elevator car door 104 is closed. Further, light from a landing adds to the light level in the elevator car 103 when the elevator car door 104 is open.

If at 518 it is determined that the elevator car door 104 is open, flow proceeds to 514 where the trapped passenger alarm is deemed a false trapped passenger alarm. The elevator system 101 can then resume normal operation by returning to block 502.

If at 518 it is determined that the elevator car door 104 is not open, flow proceeds to 520 where the trapped passenger alarm is deemed a valid trapped passenger alarm. The elevator system 101 can then initiate rescue operations, which may include moving the elevator car 103 to the nearest landing and opening the elevator car door 104 door.

Referring back to block 516, if the car is not stopped, flow proceeds to block 522 where the elevator car 103 is moved to the nearest landing (including the lobby landing). The location of the elevator car 103 may be determined by the acceleration sensed by the IMU 218 and/or pressure sensed by the pressure sensor 228. Once the elevator car 103 is at a landing, flow proceeds to 518 and the process proceeds as described above.

While the above description has described the flow process of FIG. 5 in a particular order, it should be appreciated that unless otherwise specifically required in the attached claims that the ordering of the steps may be varied.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

As described above, embodiments can be in the form of processor-implemented processes and devices for practicing those processes, such as a processor in controller 115, sensing apparatus 210 or remote device 280. Embodiments can also be in the form of computer program code containing instructions embodied in tangible media, such as network cloud storage, SD cards, flash drives, floppy diskettes, CD ROMs, hard drives, or any other computer-readable storage medium. Embodiments can also be in the form of computer program code transmitted over some transmission medium, such as over electrical wiring or cabling, through fiber optics, or via electromagnetic radiation. When implemented on a general-purpose microprocessor, the computer program code configure the microprocessor to create specific logic circuits.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of verifying a trapped passenger alarm in an elevator system including an elevator car including a sensing apparatus mounted in the elevator car, the method comprising:

obtaining at least one of acceleration of the elevator car and air pressure within the elevator car from the sensing apparatus;

detecting the trapped passenger alarm;

determining if the elevator car is stopped in response to the at least one of acceleration of the elevator car and air pressure within the elevator car;

determining that the trapped passenger alarm is one of a valid trapped passenger alarm and a false trapped passenger alarm in response to the at least one of acceleration of the elevator car and air pressure within the elevator car and in response to the determination that the elevator car is stopped.

2. The method of claim 1 wherein:

upon determining that the elevator car is not stopped, moving the elevator car to a landing.

3. The method of claim 2 wherein:

upon moving the elevator car to the landing, determining if an elevator car door is open or closed.

4. The method of claim 3 wherein:

upon determining that the elevator car door is open, determining that the trapped passenger alarm is the false trapped passenger alarm.

5. The method of claim 3 wherein:

upon determining that the elevator car door is closed, determining that the trapped passenger alarm is the valid trapped passenger alarm.

6. The method of claim 3 wherein:

determining that the elevator car door is open or closed is responsive to the acceleration of the elevator car responsive to movement of the elevator car door.

7. The method of claim 3 wherein:

determining that the elevator car door is open or closed is responsive to a light level inside the elevator car.

8. The method of claim 1 wherein:

determining that the trapped passenger alarm is one of the valid trapped passenger alarm and the false trapped passenger alarm comprises determining if the elevator car is occupied.

9. The method of claim 8 wherein:

upon determining that the elevator car is not occupied, determining that the trapped passenger alarm is the false trapped passenger alarm.

10. A method of verifying a trapped passenger alarm in an elevator system including an elevator car including a sensing apparatus mounted in the elevator car, the method comprising:

obtaining at least one of acceleration of the elevator car and air pressure within the elevator car from the sensing apparatus;

detecting the trapped passenger alarm;

determining that the trapped passenger alarm is one of a valid trapped passenger alarm and a false trapped passenger alarm in response to the at least one of acceleration of the elevator car and air pressure within the elevator car;

wherein determining that the trapped passenger alarm is one of the valid trapped passenger alarm and the false trapped passenger alarm comprises determining if the elevator car is stopped;

upon determining that the elevator car is stopped, determining if an elevator car door is open or closed.

11. The method of claim 10 wherein:

upon determining that the elevator car door is open, determining that the trapped passenger alarm is the false trapped passenger alarm.

12. The method of claim 10 wherein:

upon determining that the elevator car door is closed, determining that the trapped passenger alarm is the valid trapped passenger alarm.

13. The method of claim 10 wherein:

determining that the elevator car door is open or closed is responsive to a acceleration of the elevator car responsive to movement of the elevator car door.

14. The method of claim 10 wherein:

determining that the elevator car door is open or closed is responsive to the light level inside the elevator car.

15. An elevator system comprising:

an elevator car having an elevator car door;

a sensing apparatus mounted in the elevator car, the sensing apparatus configured to measure at least one of acceleration of the elevator car and air pressure within the elevator car;

a processor configured to execute operations including:

obtaining at least one of the acceleration of the elevator car and the air pressure within the elevator car from the sensing apparatus;

detecting a trapped passenger alarm;

determine if the elevator car is stopped in response to the at least one of acceleration of the elevator car and air pressure within the elevator car;

determining that the trapped passenger alarm is one of a valid trapped passenger alarm and a false trapped passenger alarm in response to the determination that the elevator car is stopped.

16. A computer program product tangibly embodied on a computer readable medium, the computer program product including instructions that, when executed by a processor, cause the processor to perform operations for verifying a trapped passenger alarm in an elevator system having an elevator car including a sensing apparatus mounted in the elevator car, the operations comprising:

obtaining at least one of acceleration of the elevator car and air pressure within the elevator car from the sensing apparatus;

detecting the trapped passenger alarm;

determining if the elevator car is stopped in response to the at least one of acceleration of the elevator car and air pressure within the elevator car;

determining that the trapped passenger alarm is one of a valid trapped passenger alarm and a false trapped passenger alarm in response to the at least one of acceleration of the elevator car and air pressure within the elevator car and in response to the determination that the elevator car is stopped.

* * * * *